US011162332B2

(12) United States Patent
Lopes Pereira et al.

(10) Patent No.: US 11,162,332 B2
(45) Date of Patent: Nov. 2, 2021

(54) OPTIMIZING FLUID TRANSFER DESIGN AND EXECUTION DURING WELLBORE DISPLACEMENT OPERATIONS

(71) Applicant: Halliburton Energy Services, Inc., Houston, TX (US)

(72) Inventors: Vitor Lopes Pereira, The Woodlands, TX (US); Dale E. Jamison, Humble, TX (US); Alexandra Clare Morrison, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/668,338

(22) Filed: Oct. 30, 2019

(65) Prior Publication Data

US 2021/0131234 A1 May 6, 2021

(51) Int. Cl.
*E21B 21/06* (2006.01)
*E21B 41/00* (2006.01)

(52) U.S. Cl.
CPC ..... *E21B 41/0092* (2013.01); *E21B 21/06* (2013.01)

(58) Field of Classification Search
CPC ..... E21B 21/01; E21B 21/06; E21B 21/062; E21B 21/063; E21B 21/068; E21B 41/0092
See application file for complete search history.

(56) References Cited

U.S. PATENT DOCUMENTS

| | | | | |
|---|---|---|---|---|
| 5,010,966 | A | 4/1991 | Stokeley et al. | |
| 5,109,933 | A | 5/1992 | Jackson | |
| 6,035,952 | A | 3/2000 | Bradford et al. | |
| 7,736,521 | B2 * | 6/2010 | Sloan | E21B 43/34 210/739 |
| 7,908,034 | B2 * | 3/2011 | Gray | E21B 47/10 700/282 |
| 10,208,548 | B2 * | 2/2019 | Francois | G01F 9/00 |

(Continued)

OTHER PUBLICATIONS

US 10,613,510 B2, 04/2020, Sarmiento Klapper (withdrawn)*

(Continued)

*Primary Examiner* — Kenneth L Thompson
(74) *Attorney, Agent, or Firm* — Tenley Krueger; Baker Botts L.L.P.

(57) ABSTRACT

Methods and systems for modeling the efficiency of fluid transfer between a wellbore and containers during a displacement operation. In one embodiment, the methods and systems may include providing a fluid transfer model based on constraints determined from data obtained from a wellbore servicing system, wherein the fluid transfer model comprises expected properties of the wellbore servicing system at one or more intervals during a fluid displacement operation, selecting containers for transferring a wellbore servicing fluid to a wellbore based on the expected properties, selecting containers for transferring a return fluid from the wellbore based on the expected properties, determining actual properties of the wellbore servicing system from data obtained from the wellbore servicing system, comparing the expected properties and the actual properties, and if the expected properties are different from the actual properties, modifying at least one of the expected properties of the wellbore servicing system.

20 Claims, 4 Drawing Sheets

(56) References Cited

U.S. PATENT DOCUMENTS

| | | | | |
|---|---|---|---|---|
| 2011/0198080 | A1 | 8/2011 | Demong | |
| 2016/0108687 | A1* | 4/2016 | Rapoport | E21B 49/005 175/24 |
| 2018/0363422 | A1 | 12/2018 | Roberts, IV et al. | |
| 2019/0145205 | A1* | 5/2019 | Johnson | E21B 17/01 166/363 |
| 2021/0040803 | A1* | 2/2021 | Collins | E21B 21/106 |

OTHER PUBLICATIONS

International Search Report and Written Opinion issued in related PCT Application No. PCT/US2019/059180 dated Jul. 23, 2020, 12 pages.

Javora et al. "Optimizing the Displacement Design—Mud to Brine" SPE-144212, presented at the SPE European Formation Damage Conference, Noordwijk, The Netherlands, Jun. 7-10, 2011 (10 pages).

* cited by examiner

OPTIMIZING FLUID TRANSFER DESIGN AND EXECUTION DURING WELLBORE DISPLACEMENT OPERATIONS

BACKGROUND

The present disclosure relates to subterranean treatment operations, and more particularly, in certain embodiments, to systems and methods for optimizing fluid transfer between a wellbore and one or more containers during a displacement operation.

In a well system environment, residual oil, fluids, and solids left in a wellbore by drilling and completion operations may detrimentally affect the performance of subsequent operations. A displacement operation removes solids and displaces existing fluids in the wellbore by circulating a wellbore servicing fluid (e.g., such as one or more spacer fluids) through the wellbore. Displacement operations remove unwanted fluid deposits through both mechanical and chemical means of cleaning. Failure to perform an effective displacement operation may create unnecessary burdens for logistics and rig resources, for example, by hindering completion operations and damaging the wellbore. Upon exiting the wellbore, displaced return fluids are transferred to one or more containers located at the wellsite. Wellbore servicing fluids used in the displacement operation also may be stored in the containers ahead of transfer to the wellbore.

A fluid transfer model may involve the planning of the transfer of fluids between the wellbore and one or more containers ahead of displacement operations according to numerous properties of a wellbore servicing system that may change during the course of a displacement operation. One key objective of most fluid transfer models is the effective transfer of fluids between the wellbore and the containers. However, determining the efficiency of fluid transfer from the wellbore presents numerous challenges. For instance, changes to any one or more properties of the wellbore servicing system during a displacement operation may require immediate adjustments to the plan.

Fluid transfer model design also presents challenges. Accurate modeling of fluids and the wellsite structures, and equipment involved in the displacement operation require attention to numerous variable properties of a wellbore servicing system including surface constraints, downhole constraints, and various operational constraints. As a result, existing computational methods are often unwieldy, take longer than operationally practical, or are based on data mining that most often requires extrapolation over existing data boundaries. These challenges create unnecessary burdens for logistics and rig resources.

BRIEF DESCRIPTION OF THE DRAWINGS

These drawings illustrate certain aspects of some of the embodiments of the present disclosure and should not be used to limit or define the claims.

Figure 1:
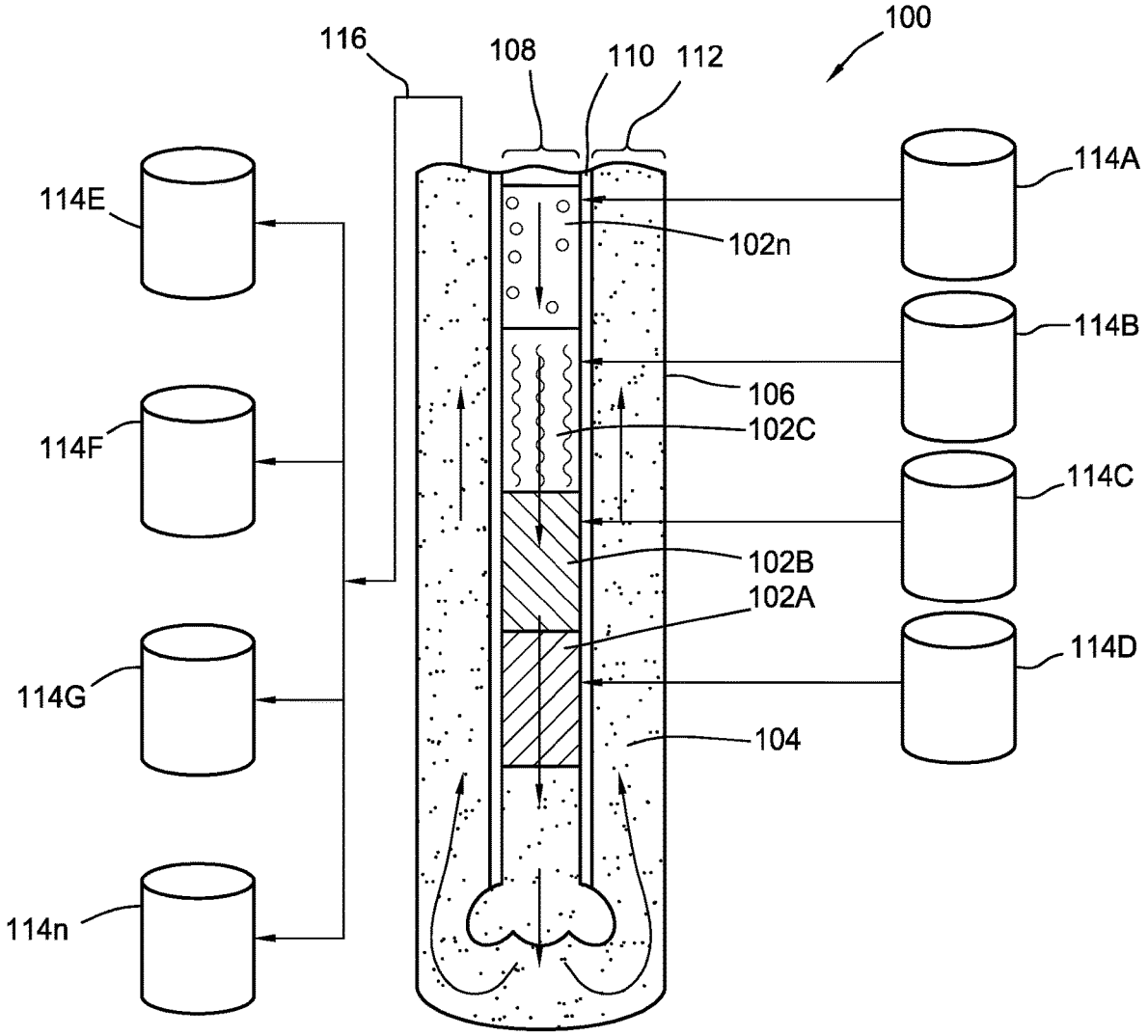
FIG. 1 is a schematic diagram of a system in which a wellbore servicing fluid displaces existing fluid in a wellbore, according to one or more aspects of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

The present disclosure relates generally to operations performed and equipment utilized in conjunction with a subterranean wellbore. More particularly, the present disclosure relates to methods and systems for optimizing fluid transfer between a wellbore and one or more containers during a displacement operation.

A wellbore fluids displacement operation (hereinafter "displacement operation") refers to the circulation of a wellbore servicing fluid in a wellbore to remove solids and displace an existing fluid from the wellbore before the introduction of another fluid. In some embodiments, a displacement operation may be performed to displace the existing fluid in the wellbore with a wellbore servicing fluid, such that the existing fluid is no longer present or detectable in the wellbore (or desired portions of the wellbore). Displaced fluid (i.e., return fluid) may be transferred and stored one or more containers located at the wellsite (e.g., one or more ponds, sumps, pits, tanks, or a combination thereof). Wellbore servicing fluids also may be stored in one or more of the containers before introduction into the wellbore.

The methods disclosed herein include the use of various wellbore compositions, including wellbore servicing fluids. As used herein, "wellbore composition" includes any composition that may be prepared or otherwise provided at the surface and placed down the wellbore, typically by pumping. As used herein, "servicing fluid" refers to a fluid used to drill, complete, work over, fracture, repair, treat, or in any way prepare or service a wellbore for the recovery of materials residing in a subterranean formation penetrated by the wellbore. Examples of servicing fluids include, but are not limited to, spacer fluids, completion fluids, cement slurries, non-cementitious sealants, drilling fluids or muds, or fracturing fluids, all of which are well known in the art.

According to one or more aspects of the present disclosure, the techniques and operations described herein may be implemented by one or more information handling systems configured to provide the functionality described. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. In any embodiment, the information handling system may include a non-transitory computer readable medium that stores one or more instructions where the one or more instructions when executed cause the processor to perform one or more actions. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

One or more embodiments of the methods and systems of the present disclosure may include one or more fluid transfer models for simulating a displacement operation at a well site. For example, the one or more fluid transfer models may simulate or otherwise analyze the dynamic transfer of fluid in or between various locations at a well site. For example, the wellbore monitoring system may simulate the transfer of fluid between two or more of a wellbore, one or more containers, and one or more equipment components used to transfer fluid therebetween during a displacement operation. In one or more embodiments, the fluid transfer model may simulate transfer of a wellbore servicing fluid from a first set of one or more containers located at the well site. In one or more embodiments, the fluid transfer model may simulate transfer of a return fluid from the wellbore to a second set of one or more containers located at the well site. In one or more embodiments, the fluid transfer model may simulate distribution of the wellbore servicing fluid and return fluid across the first and second set of containers. In one or more embodiments, the fluid transfer model may simulate the addition of transportable containers to the well site. In one or more embodiments, the fluid transfer model may simulate recycling and/or re-use of fluids stored in the set of one or more containers. In one or more embodiments, the fluid transfer model may simulate the use of one or more pumps and one or more lines used to transfer fluids between a set of one or more containers and the wellbore. In one or more embodiments, the fluid transfer model may simulate the addition of additives to a fluid.

In one or more embodiments, the one or more fluid transfer models may model flow in one, two, or three spatial dimensions. In one or more embodiments, the wellbore monitoring system may generate a plurality of nodes or a mesh for use in the one or more fluid transfer models. In one or more embodiments, the fluid transfer model may include maps, diagrams, lists, schedules, animations, reports, and the like. In one or more embodiments, the fluid transfer model may be designed or otherwise provided on an information handling system such as an information handling system included on a wellbore monitoring system.

In one or more embodiments, a wellbore servicing fluid control subsystem may control a displacement operation based on one or more fluid transfer models simulated by the wellbore monitoring system. In one or more embodiments, a wellbore servicing fluid control subsystem may communicate with the wellbore monitoring system to implement one or more fluid transfer models before, during, or after the displacement operation. In one or more embodiments, the wellbore servicing fluid control subsystem may use a fluid transfer model to control transfer of a wellbore servicing fluid from a first set of one or more containers located at the well site. In one or more embodiments, the wellbore servicing fluid control subsystem may use a fluid transfer model to control transfer of a return fluid from the wellbore to a second set of one or more containers located at the well site. In one or more embodiments, the wellbore servicing fluid control subsystem may use a fluid transfer model to control distribution of the wellbore servicing fluid and return fluid across the first and second set of containers. In one or more embodiments, the wellbore servicing fluid control subsystem may use a fluid transfer model to control the addition of transportable containers to the well site. In one or more embodiments, the wellbore servicing fluid control subsystem may use a fluid transfer model to control recycling and/or re-use of fluids stored in the set of one or more containers. In one or more embodiments, the wellbore servicing fluid control subsystem may use a fluid transfer model to control one or more pumps and one or more lines used to transfer fluids between a set of one or more containers and the wellbore. In one or more embodiments, the wellbore servicing fluid control subsystem may use a fluid transfer model to control the addition of additives to the transferred fluids.

In certain embodiments, the one or more fluid transfer models are designed or otherwise provided based on one or more constraints of a wellbore servicing system including one or more of fluids, structures, and equipment involved in a displacement operation. In one or more embodiments, the one or more fluid transfer models are designed or otherwise provided based on constraints including, but not limited to, surface properties, downhole properties, and defined properties of a wellbore servicing system. In one or more embodiments, the surface properties may include, but are not limited to, container layout, number of containers, container dimensions, one or more wellbore servicing fluid types, one or more wellbore servicing fluid volumes, one or more wellbore servicing fluid masses, one or more wellbore servicing fluid densities, number of flow paths, flow path dimensions, one or more surface temperatures, number of pumps, pump rate, one or more pump volumes, and any combination thereof. Downhole properties may include, but are not limited to, one or more wellbore temperatures, one or more return fluid types, one or more return fluid volumes, one or more return fluid masses, one or more return fluid densities, one or more contamination type, one or more contamination volumes, one or more contamination masses, one or more contamination densities, tool string assembly dimensions, lithology dimensions, and any combination thereof. Defined properties may include, but are not limited to, one or more environmental regulations, one or more maximum container operating volumes, one or more minimum container operating volumes, one or more fluid mixing limitations, one or more maximum pumping pressures, one or more target fluid specifications, and any combination thereof.

In one or more embodiments, one or more constraints are determined based on data obtained from the wellbore servicing system. In one or more embodiments, the one or more constraints may be determined based on one or more sensors configured to collect data about the fluids, structures, and equipment involved in a displacement operation. Suitable sensors may include surface sensors and/or downhole sensors configured to collect data such as a density, a pressure, a rate, a temperature, a dimension, and any other properties of the fluids, structures, and equipment involved in a displacement operation.

In one or more embodiments, the one or more fluid transfer models may include one or more expected properties of the wellbore servicing system. In one or more embodiments, one or more constraints may be used to generate the one or more expected properties. In one or more embodiments, the expected properties may be extrapolated or otherwise simulated based on the constraints.

In one or more embodiments, the expected properties may be used to track the status of the fluid transfer model and/or progress of a displacement operation. In one or more embodiments, the one or more expected properties may be generated for one or more intervals during a displacement operation. In one or more embodiments, the one or more intervals may include time intervals, pumps strokes, volumes, and the like.

In one or more embodiments, the fluid transfer model may include one or more selections based on the one or more constraints and/or expected properties of the fluid transfer model. In one or more embodiments, the one or more selections may include selection of one or more containers, equipment, a wellbore servicing fluid (e.g., one or more spacers), one or more additives, and the like. For example, the one or more containers for storing the one or more spacers before transfer to a wellbore may be selected based on one or more properties of the spacers, based on one or more properties of one or more additives to the spacers, whether the one or more containers are clean or contaminated, whether the one or more containers have previously stored similar spacers, the proximately of each container in relation to each other and/or to the other structures and equipment involved in the displacement operation, and the like, and any combination thereof. In another example, the one or more containers for transferring a return fluid from the wellbore may be selected based on the properties of the return fluid 116. In one or more embodiments, a return fluid within a first density and/or viscosity range may be deposited in a first container, a return fluid within a second density and/or viscosity range may be deposited in a second container, and so forth. In one or more embodiments, a first container including one or more contaminants may be selected to store a return fluid including the one or more contaminants. In one or more embodiments, selecting the first container to store the return fluid including one or more contaminants may eliminate the need to clean the first container between displacement operations. In one or more embodiments, the one or more selections may be based on optimizing a displacement operation. For example, the one or more selections may be made based on limiting an amount of time and/or space used during a displacement operation.

In one or more embodiments, the fluid transfer model may be modified based on comparison of on one or more differences between the one or more expected properties and one or more actual properties at one or more intervals during a displacement operation. Actual properties may be determined based on data obtained from a wellbore servicing system at one or more intervals during a displacement operation. In one or more embodiments, actual properties may include data collected from fluids, structures, and equipment at various intervals during a displacement operation. In one or more embodiments, the one or more actual properties may be determined based on one or more sensors configured to collect data about the fluids, structures, and equipment involved in a displacement operation. Suitable sensors may include surface sensors and/or downhole sensors configured to collect data such as a density, a pressure, a rate, a temperature, a dimension, and any other properties of the fluids, structures, and equipment involved in a displacement operation. In one or more embodiments, the fluid transfer model may be modified by adjusting the expected properties at least in part based on the one or more differences between at least one of the one or more actual properties and at least one of the one or more expected properties. In one or more embodiments, modifications to the fluid transfer model are performed in real time. In one or more embodiments, the displacement operation may be implemented based on the modified fluid transfer model. In some embodiments the fluid transfer model may be implemented without modification if no differences are determined between the one or more actual properties and the one or more expected properties.

One or more embodiments of the present disclosure include a method of implementing a fluid transfer model for use in a displacement operation. The method, one or more individual steps of the method, or groups of steps may be iterated or performed in parallel, in series, or in another manner. In one or more embodiments, the method may include the same, additional, fewer, or different steps performed in the same or a different order. In one or more embodiments, a wellbore monitoring system may implement any one or more steps of the method.

In one or more embodiments, one or more steps of the methods of the present disclosure may include determining one or more constraints for the fluid transfer model using, at least in part, one or more surface sensors, downhole sensors, container sensors, any other type of sampling system known in the art, and/or any combination thereof. For example, one or more downhole sensors may determine one or more properties (e.g., a density, volume, total dissolved solids, etc.) of an existing fluid in a wellbore. In another example, one or more sensors may determine a capacity of one or more containers. In one or more embodiments, the calculations used to determine the one or more constraints may include any one or more of one or more governing equations, one or more empirical models, one or more associated variables, and any combination thereof.

In one or more embodiments, one or more steps may include designing or otherwise providing one or more fluid transfer models by determining one or more expected properties based on the one or more constraints. In one or more embodiments, the one or more constraints may be used to calculate the one or more expected properties at one or more intervals of a displacement operation. In one or more embodiments, the calculations used to provide the fluid transfer model may include any one or more of one or more governing equations, one or more empirical models, one or more associated variables, and any combination thereof. In one or more embodiments, the one or more fluid transfer models may be designed or otherwise provided by an information handling system such as a fluid transfer simulation module of a wellbore monitoring system. In one or more embodiments, the fluid transfer simulation module may be coupled to one or more other modules of the wellbore monitoring system, including, but not limited to, a hydraulics displacement simulation module, a spacer contamination simulation module, and any combination thereof and receiving simulation data including at least one of the one or more expected properties from one or more of these modules. For example, a spacer contamination simulation module may provide one or more expected densities of a return fluid at one or more intervals during a displacement operation to the fluid transfer simulation module based on various calculations performed by the spacer contamination module using from data collected from an existing fluid in a wellbore.

In one or more embodiments, an additional step may include determining one or more actual properties using, at least in part, one or more sensors. In one or more embodiments, the actual properties are determined using at least one of the sensors used to determine the constraints. In one or more embodiments, the actual properties may be determined at one or more intervals before, during, and/or after a displacement operation. For instance, one or more sensors may determine one or more properties (e.g., a density, volume, total dissolved solids, etc.) of a return fluid from a wellbore. As another example, one or more sensors may check a fluid capacity of one or more containers.

In one or more embodiments, one or more steps may include comparing at least one of the one or more expected properties and at least one of the one or more actual properties.

In one or more embodiments, the comparison is used to characterize the accuracy of the one or more fluid transfer models during the displacement operation. In one or more embodiments, the calculations used to perform the comparison may include any one or more of one or more governing equations, one or more empirical models, one or more associated variables, and any combination thereof. Suitable comparisons may include, but are not limited to, comparing the actual density of the return fluid with the expected density of the return fluid after a predetermined interval, correlating one or more actual properties such as actual density of the return fluid or the actual capacity of one or more containers with one or more pump strokes, correlating one or more actual properties such as actual density of the return fluid with the density of the wellbore servicing fluids pumped in a displacement operation.

In one or more embodiments, the fluid transfer model is modified if the comparison step determines one or more differences between at least one of the one or more actual properties and one or more expected properties. In one or more embodiments, the calculations used to modify the fluid transfer model may include any one or more of one or more governing equations, one or more empirical models, one or more associated variables, and any combination thereof. In one or more embodiments, modification of the one or more fluid transfer models may be performed through automated means, such as by one or more information handling systems of a wellbore monitoring system. In one or more embodiments, one or more expected properties may be adjusted based on one or more actual properties if one or more differences between at least one actual property and at least one expected property are determined. For instance, if a density, viscosity, and/or TDS comparison indicates that a higher proportion of existing fluid to wellbore servicing fluid is present in the return fluid than indicated by expected properties of the fluid transfer model, the expected properties of fluid transfer model may be modified reflect the actual density, viscosity, and/or TDS of the return fluid. In one or more embodiments, the fluid transfer model is further modified to adjust the distribution of volumes of return fluid across one or more containers so that each container contains return fluid within a particular density, viscosity, and/or TDS range. As another example, if the comparison indicates a reduced operating volume for one or more containers, the fluid transfer model may be modified to adjust and/or redistribute the volume of wellbore servicing fluid transferred to the one or more containers in real time during the displacement operation. In one or more embodiments, a wellbore fluid control subsystem may be used to automatically modify the displacement operation based on the modification to the fluid transfer model.

In some embodiments, one or more steps implementing the fluid transfer model may be performed continuously, throughout part of, or throughout an entire displacement operation. In some embodiments, one or more steps implementing the fluid transfer model may be performed at one or more intervals throughout part or all of a displacement operation. In some embodiments, one or more steps implementing the fluid transfer model may be performed until at least one of the one or more actual properties is equivalent to one or more goal properties of the fluid transfer model, at which point the one or more steps implementing the fluid transfer model may be terminated. In some embodiments, determination of one or more goal properties may indicate completion of the displacement operation and/or initiation of a new model simulating another wellbore operation. In one or more embodiments, the fluid control subsystem may use the determination of one or more goal properties by the wellbore monitoring system to terminate the displacement operation.

Among the many potential advantages to the methods and systems of the present disclosure, only some of which are alluded to herein, the methods and systems of the present disclosure may improve the design and planning of displacement operations. In some embodiments, the methods and systems of the present disclosure may improve modifications to displacement operations. In some embodiments, the methods and systems of the present disclosure may improve the efficiency of displacement operations. In some embodiments, the methods and systems of the present disclosure may improve modifications to fluid transfer models. In some embodiments, the methods and systems of the present disclosure may improve the efficiency of fluid transfer models. In some embodiments, the methods and systems of the present disclosure may improve the communication of fluid transfer management plans between wellsite personnel. In some embodiments, the methods and systems of the present disclosure may reduce time spent planning and modifying fluid transfer management plans. In some embodiments, the methods and systems of the present disclosure may reduce waste of wellbore servicing fluids and/or other fluids used during well site operations. In some embodiments, the methods and systems of the present disclosure may reduce time spent cleaning containers in which wellbore servicing fluids and/or other fluids used during well site operations are stored. In some embodiments, the methods and systems of the present disclosure may increase wellsite safety. In some embodiments, the methods, compositions, and systems of the present disclosure may improve performance and/or cost-benefit in displacement operations.

To facilitate a better understanding of the present invention, the following examples of certain embodiments are given. In no way should the following examples be read to limit, or define, the scope of the invention. One or more embodiments of the present disclosure may be applicable to any type of well site operation including, but not limited to, exploration, services or production operation for any type of well site or container environment including subsurface and subsea environments.

Referring now to FIG. 1, illustrated is a schematic diagram 100 of a system in which a wellbore servicing fluid (e.g., a displacement train of one or more spacers 102A-n) displaces existing fluid 104 in a wellbore 106, according to one or more aspects of the present invention. In one or more embodiments, the one or more spacers 102A-n are transferred sequentially downhole through an interior conduit 108 of a drill string 110 and through one or more orifices in the drill bit 111. The one or more spacers 102A-n displace the existing fluid 104, which is circulated back to the surface via an annulus 112 defined between the drill string 110 and the walls of the wellbore 106.

In certain embodiments, each spacer 102A-n may include any one or more wellbore servicing fluids, and the existing fluid 104 may include any one or more fluids. In one or more embodiments, any of the spacers 102A-n may be the same as or similar to any one or more existing fluids 104. In one or more embodiments, any of the spacers 102A-n may be the same as or similar to any of the other spacers 102A-n. In one or more embodiments, spacers 102A-n are provided from a first set of one or more containers 114A-D located near the wellbore 106. Upon returning to the surface via the annulus 112, the existing fluid 120, displacement train, and any solids included therein exit the wellbore as a return fluid 116, portions of which may be transferred to a second set of one or more containers 114E-n.

In FIG. 1, the one or more spacers 102A-n and the existing fluid 104 may be miscible fluids with one or more distinct properties. For example, each spacer 102A-n may include or may be described or distinguished by a viscosity $\mu_{1A}$ through $\mu_{1N}$ and a density $\rho_{1A}$ through $\rho_{1N}$ and existing fluid 104 may include or may be described or distinguished by a viscosity $\mu_2$, a density $\rho_2$, and a percentage of total dissolved solids ("TDS") where $\mu_{1A\text{-}1N} \neq \mu_2$ or $\rho_{1A\text{-}1N} \neq \rho_2$. In one or more embodiments, the existing fluid 104 and the one or more spacers 102A-n may at least partially mix together during the displacement operation. At the beginning of the displacement operation, the return fluid 116 may have a viscosity and density substantially similar to existing fluid 104. As the displacement operation progresses, the return fluid 116 may include sequentially higher proportions of each of the one or more spacers 102A-n until the return fluid 116 substantially has the viscosity and density of spacer 102*n*. In one or more embodiments, one or more properties of the return fluid 116 may be measured at one or more time intervals during the displacement operation.

Figure 2:
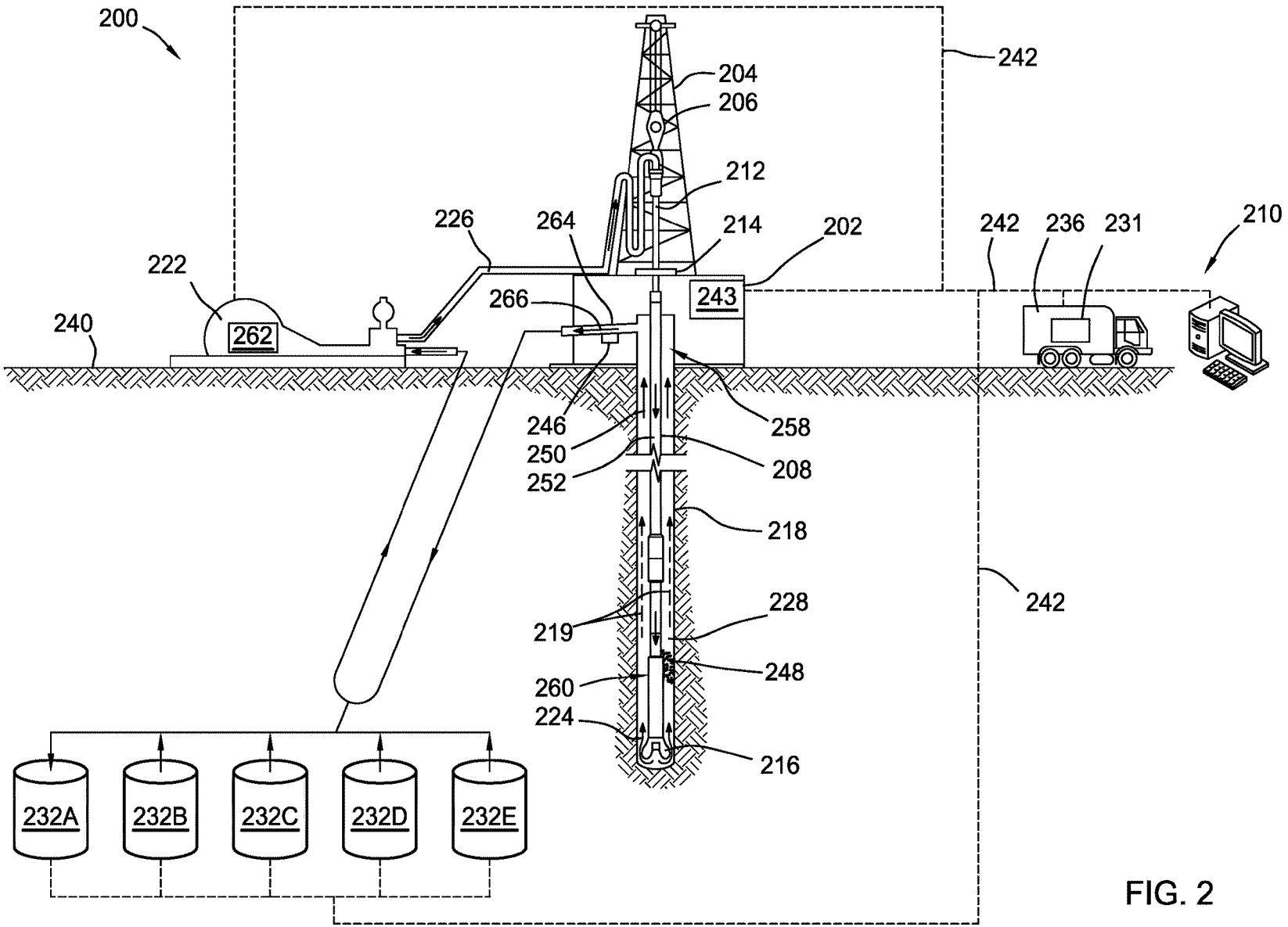
FIG. 2 is a schematic diagram of a wellbore servicing system, according to one or more aspects of the present disclosure.

FIG. 2 illustrates a wellbore servicing system 200 and wellbore monitoring system 210 that may employ one or more of methods described herein in order to model fluid transfer during a displacement operation, according to one or more embodiments. The example wellbore servicing system 200 includes a drilling platform 202 that supports a derrick 204 having a traveling block 206 for raising and lowering a drill string 208. A kelly 212 supports the drill string 208 as it is lowered through a rotary table 214. A drill bit 216 is attached to the distal end of the drill string 208 and is driven either by a downhole motor and/or via rotation of the drill string 208 from the well surface. As the bit 216 rotates, it creates a wellbore 218 that penetrates various subterranean formations 220. The example wellbore 218 shown in FIG. 2 includes a vertical wellbore. However, a wellbore servicing system 200 may include any combination of horizontal, vertical, slant, curved, or other wellbore orientations.

A pump system 222 (for example, a mud pump) circulates wellbore servicing fluid 224 through a feed pipe 226 and to the kelly 212, which conveys the wellbore servicing fluid 224 downhole through an interior conduit 252 defined in the drill string 208 and through one or more orifices in the drill bit 216. The wellbore servicing fluid 224 is then circulated back to the surface via an annulus 228 defined between the drill string 208 and the walls of the wellbore 218. The route through which wellbore servicing fluid 224 circulates may be described using one or more fluid flow paths 219.

The wellbore servicing fluid 224 may carry out several functions, such as the mechanical and chemical removal of one or more fluid deposits from wellbore walls, and the mechanical removal of cuttings and other solids. The wellbore servicing fluid 224 may be any wellbore fluid known to those skilled in the art. In one or more embodiments, for example, the wellbore servicing fluid 224 may be a spacer fluid, a completion fluid, a cement slurry, a non-cementitious sealant, a drilling fluid or mud, a fracturing fluid, water, or a combination thereof. The water wellbore servicing fluid 224 may be, but is not limited to, municipal treated or fresh water, sea water, salt water such as brine (e.g., water containing one or more salts dissolved therein), a naturally-occurring brine, a chloride-based, bromide-based, or formate-based brine containing monovalent and/or polyvalent cations, aqueous solutions, non-aqueous solutions, base oils, and any combination thereof. Examples of chloride-based brines include sodium chloride and calcium chloride. Examples of bromide-based brines include sodium bromide, calcium bromide, and zinc bromide. Examples of formate-based brines include sodium formate, potassium formate, and cesium formate. To those of ordinary skill in the art, one or more types of wellbore servicing fluid 224 may be referred to as a "pill" or a "spacer."

Wellbore servicing fluid 224 may be conveyed or otherwise introduced into the wellbore 218 at predetermined intervals of time in order to, among other things, clean up the wellbore 218 and displace one or more existing fluids 250 from the wellbore 218. For example, in a displacement operation, the wellbore servicing fluid 224 may be circulated through the wellbore 218 along one or more fluid flow paths 219 in order to flush the existing fluids 250 including residual substances 248 such drilling fluids and solids out of the wellbore 218. For instance, the wellbore servicing fluid 224 may be circulated through the wellbore 218 at the end of a drilling operation in order to perform a displacement operation of the wellbore 218 in preparation for hydrocarbon production. The displacement of existing fluids 250 by wellbore servicing fluid 224 may include miscible fluid displacement. Miscible fluid displacement results in a return fluid 266, which may include wellbore servicing fluid 224 and existing fluid 250. An embodiment of miscible fluid displacement is explained in FIG. 2. In one or more embodiments, existing fluids 250 may include one or more wellbore servicing fluids 224 that remain in the wellbore 218 due to an incomplete or partial circulation of wellbore servicing fluids 224.

In one or more embodiments, wellbore servicing system 200 includes one or more instrument trucks 236, a pump system 222, and a wellbore servicing fluid control subsystem 231. The wellbore servicing system 200 may perform one or more displacement operations that include, for example, a multi-stage displacement operation, a single-stage displacement operation, a final displacement operation, other types of displacement operations, or a combination of these. For example, a displacement operation may circulate one or more wellbore servicing fluids 224 (e.g., a sequence of one or more spacers) over a single time period or a plurality of time periods. The circulation of a plurality of wellbore servicing fluids 224 in sequential order forms a "displacement train." Moreover, the wellbore servicing system 200 can circulate fluid through any suitable type of wellbore, such as, for example, vertical wellbores, slant wellbores, horizontal wellbores, curved wellbores, or combinations of these and others.

The pump system 222 may include any one or more of one or more mobile vehicles, one or more immobile installations, one or more skids, one or more hoses, one or more tubes, one or more fluid tanks, one or more containers 232, one or more pumps, one or more valves, one or more mixers, or any other one or more types of structures and equipment. The pump system 222 shown in FIG. 1 may supply wellbore servicing fluid 224 or other materials from one or more containers for the displacement operation. The pump system 222 may convey the wellbore servicing fluid 224 downhole through the interior conduit 252 defined in the drill string 208 and through one or more orifices in the drill bit 216.

The one or more instrument trucks 236 may include mobile vehicles, immobile installations, or other structures. The one or more instrument trucks 236 shown in FIG. 2 include a wellbore servicing fluid control subsystem 231 that controls or monitors the displacement operation applied by the wellbore servicing system 200. One or more communication links 242 may communicatively couple the one or more instrument trucks 236 to the pump system 222, the one or more containers 232 or other equipment at a ground surface 240. In one or more embodiments, the one or more communication links 242 may communicatively couple the one or more instrument trucks 236 to one or more controllers 243 disposed at or about the wellbore, one or more sensors (such as surface sensors 258 and downhole sensors 260), other one or more data collection apparatuses in the wellbore servicing system 200, remote systems, other well systems, any equipment installed in the wellbore 218, other devices and equipment, or a combination thereof. In one or more embodiments, the one or more communication links 242 communicatively couple the one or more instrument trucks 236 to the wellbore monitoring system 210, which may run one or more simulations and record simulation data. The wellbore servicing system 200 may include a plurality of uncoupled communication links 242 or a network of coupled communication links 242. The communication links 242 may include direct or indirect, wired or wireless communications systems, or combinations thereof.

The wellbore servicing system 200 may also include one or more surface sensors 258 and one or more downhole sensors 260 to measure a pressure, a rate, a temperature, and any other properties of displacement operations. For example, the surface sensors 258 and downhole sensors 260 may include meters or other equipment that measure properties of one or more fluids in the wellbore 218 at or near the ground surface 240 level or at other locations. The wellbore servicing system 200 may include one or more pump controls 262 or other types of controls for starting, stopping, increasing, decreasing or otherwise controlling pumping as well as controls for selecting or otherwise controlling fluids pumped during the displacement operation. The wellbore servicing fluid control subsystem 231 may communicate with the one or more of one or more surface sensors 258, one or more downhole sensors 260, one or more pump controls 262, and other equipment to monitor and control the displacement operation.

In one or more embodiments, the wellbore servicing system 200 may include one or more sampling systems 246 arranged, disposed or positioned along or in a fluid flow path 219 such as one or more return lines 264 in order to monitor one or more pumped fluids contained therein. The one or more sampling systems 246 collect one or more samples of one or more pumped fluids (such as return fluid 266 including wellbore servicing fluids 224, existing fluids 250, and residual substances 248) as the return fluid 266 returns to the surface 240 and capture information associated with the one or more samples, such as pump stroke and a time at which a sample was conducted. One or more properties may be measured for the different samples, enabling an analysis of the progress and quality of the displacement operation and the fluid transfer model. The one or more properties measured may include any one or more of density, viscosity, water content, oil content, solids content, salt content, capacitance, thermal and electrical conductivity, electrical stability (ES), and acidity (pH). In one or more embodiments, the one or more sampling systems 246 may be optical computing devices specifically configured for detecting, analyzing, and quantitatively measuring a particular characteristic of the pumped fluid or a component present within the pumped fluid. In one or more embodiments, the optical computing devices may be general purpose optical devices, with post-acquisition processing (for example, through computer means) being used to specifically detect the characteristic of the sample. The optical computing devices can perform calculations (analyses) in real time or near real time without the need for time-consuming sample processing.

In one or more embodiments, the sampling systems 246 may be used to conduct a "flow back analysis," as is known to those of ordinary skill in the art. In a flow back analysis, one or more samples of a return fluid 266 are collected from a fluid flow path 219 such as one or more return lines 264 in order to assess one or more properties of the return samples.

In one or more embodiments, the wellbore servicing system 200 may include one or more containers 232A-E arranged, disposed or positioned between one or more return lines 264 and the pump system 222 in order to store displaced return fluid 266 for disposal, recycling, or reuse in a displacement operation or other wellsite operation. One or more containers 232A-E may also store wellbore servicing fluid 224 such as one or more spacers. The one or more containers 232A-E may separately store different spacers to be used at different times during the displacement operation. The containers 232A-E may be connected in series, parallel, or independently connected to the wellbore 213 or the pump system 222. The containers 232A-E may be interconnected or isolated. In one or more embodiments, the containers may include one or more sensors to monitor properties associated with the containers 232A-E and properties of the one or more fluids contained therein. In one or more embodiments, at least one of the containers may include one or more servicing fluid reclamation equipment (not shown). The reclamation equipment may be configured to receive and rehabilitate return fluid 266 in preparation for its reintroduction into the wellbore 218 as a wellbore servicing fluid 224, if desired. The reclamation equipment may include one or more filters or separation devices configured to clean the return fluid 266.

The wellbore monitoring system 210 may include one or more information handling systems (such as the information handling system represented in FIG. 3) located at the wellbore 218 or any one or more other locations. The wellbore monitoring system 210 or any one or more components of the wellbore monitoring system 210 may be located remote from any one or more of the other components shown in FIG. 2. For example, the wellbore monitoring system 210 may be located at a data processing center, a computing facility, or another suitable location.

In one or more embodiments, the wellbore servicing fluid control subsystem 231 shown in FIG. 2 controls operation of the wellbore servicing system 200. The wellbore servicing fluid control subsystem 231 may include one or more data processing equipment, one or more communication equipment, or other systems that control the transfer of fluids between the wellbore 218 and one or more containers 232A-E during a displacement operation. The wellbore servicing fluid control subsystem 231 may be communicatively linked or communicatively coupled to the wellbore monitoring system 210, which may calculate, select, adjust, or modify a fluid transfer model.

In one or more embodiments, the fluid transfer model may be generated on a fluid transfer simulation module of the wellbore monitoring system 210. The fluid transfer simulation module may interact with one or more additional modules run on the wellbore monitoring system 210. For example, in some embodiments, the fluid transfer simulation module may be coupled to a hydraulics displacement simulation module, a spacer contamination simulation module, and the like, and any combination thereof. For example, in one or more embodiments, the fluid transfer simulation module may communicate with the spacer contamination simulation module to generate one or more fluid transfer models that include selecting one or more containers for storing one or more spacers for use in a displacement operation. In one or more embodiments, the fluid transfer simulation module may communicate with the spacer contamination simulation module to modify one or more properties of one or more spacers stored in one or more containers before transferring the spacers to the wellbore in a displacement operation.

In one or more embodiments, the wellbore monitoring system 210 may simulate one or more fluid transfer models including one or more digital simulations of various components of the wellbore servicing system 200 as illustrated in FIG. 2 to describe, predict, or otherwise analyze the dynamic transfer of fluid in the wellbore servicing system 200. In one or more embodiments, the wellbore monitoring system 210 may simulate fluid flow in or between various locations of the wellbore servicing system 200, such as, for example, the wellbore 218, the drill string 208, one or more containers 232A-E, any other components, and any combination thereof. In one or more embodiments, the one or more fluid transfer models may model flow in one, two, or three spatial dimensions. The one or more fluid transfer models may include maps, lists, reports, animations, and the like, that describe, illustrate, animate, or otherwise convey one or more of the various components of the wellbore servicing system 200. The wellbore monitoring system 210 may generate a plurality of nodes or a mesh including one or more of the various components of the wellbore servicing system 200 for use in the one or more fluid transfer models.

The wellbore monitoring system 210 may perform one or more simulations before, during, or after the displacement operation. In one or more embodiments, the wellbore servicing fluid control subsystem 231 may control the displacement operation performed by the wellbore servicing system 200 based on one or more simulations performed by the wellbore monitoring system 210. For example, the wellbore servicing fluid control subsystem 231 may implement a one or more fluid transfer models including a container schedule generated in advance by the wellbore monitoring system 210. The container schedule may include, for example, a schedule for containers 232A-E, including the determination of one or more active containers, suction containers, contaminated containers, wellbore servicing fluid containers, reclamation containers, return fluid containers, a pumping schedule or one or more other aspects of the displacement operation. As another example, the wellbore servicing fluid control subsystem 213 may implement real time modifications to the container schedule based on one or more real time modifications to the one or more fluid transfer models in during the displacement operation. For example, the wellbore servicing fluid control subsystem 213 may change which of containers 232A-E will be active containers, suction containers, contaminated containers, wellbore servicing fluid containers, reclamation containers, and/or return fluid containers for the remainder of the displacement operation.

In one or more embodiments, the one or more simulations are based on data obtained from the wellbore servicing system 200. For example, sensors and equipment including one or more pressure meters, one or more flow monitors, one or more microseismic equipment, one or more tiltmeters, or other equipment can perform measurements before, during, or after a displacement operation; and the wellbore monitoring system 210 may simulate fluid transfer based on the measured data. In one or more embodiments, the wellbore servicing fluid control subsystem 231 may select one or more containers as storage for certain fluids, modify the distributions of fluid across the one or more containers or recommend dispatch for additional containers, recommend re-use of fluids stored in one or more containers, recommend continuation of pumping based on one or more properties of the return fluid, recommend termination of the displacement operation based on one or more properties of the return fluid, plan and coordinate the addition of additives to the wellbore servicing fluid, recommend on-the-fly addition of additives to the wellbore servicing fluid, and the like, based on data provided by the one or more simulations. In one or more embodiments, data provided by the one or more simulations may be displayed in real time during the displacement operation, for example, to an engineer or other operator of the wellbore servicing system 200.

The wellbore servicing system 200 may include additional or different features, and the features of the wellbore servicing system 200 may be arranged as shown in FIG. 2 or in another configuration.

Figure 3:
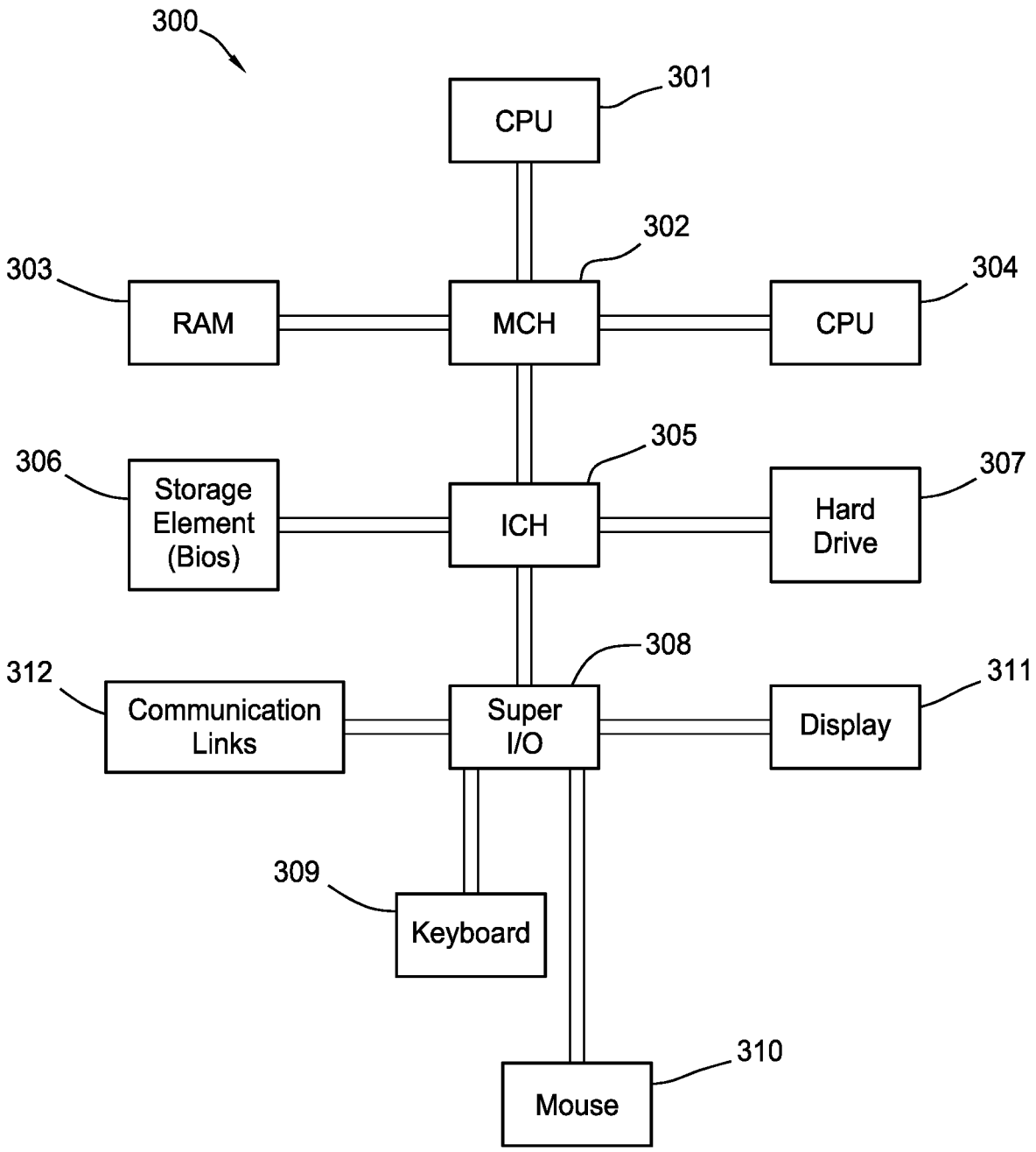
FIG. 3 is a diagram illustrating an information handling system, according to one or more aspects of the present disclosure.

FIG. 3 is a diagram illustrating an example information handling system 300, according to one or more aspects of the present disclosure. The wellbore monitoring system 210 in FIG. 2 may take a form similar to the information handling system 300 or include one or more components of information handling system 300. A processor or central processing unit (CPU) 301 of the information handling system 300 is communicatively coupled to a memory controller hub (MCH) or north bridge 302. The processor 301 may include, for example a microprocessor, microcontroller, digital signal processor (DSP), application specific integrated circuit (ASIC), or any other digital or analog circuitry configured to interpret and/or execute program instructions and/or process data. Processor 301 may be configured to interpret and/or execute program instructions or other data retrieved and stored in any memory such as memory 303 or hard drive 307. Program instructions or other data may constitute portions of a software or application for carrying out one or more methods described herein. Memory 303 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software or application may be retrieved and stored in memory 303, for example, a non-transitory memory, for execution by processor 301.

Modifications, additions, or omissions may be made to FIG. 3 without departing from the scope of the present disclosure. For example, FIG. 3 shows a particular configuration of components of information handling system 300. However, any suitable configurations of components may be used. For example, components of information handling system 300 may be implemented either as physical or logical components. Furthermore, in one or more embodiments, functionality associated with components of information handling system 300 may be implemented in special purpose circuits or components. In other embodiments, functionality associated with components of information handling system 300 may be implemented in configurable general-purpose circuit or components. For example, components of information handling system 300 may be implemented by configured computer program instructions.

Memory controller hub 302 may include a memory controller for directing information to or from various system memory components within the information handling system 300, such as memory 303, storage element 306, and hard drive 307. The Memory controller hub 302 may be coupled to memory 303 and a graphics processing unit (GPU) 304. Memory controller hub 302 may also be coupled to an I/O controller hub (ICH) or south bridge 305. I/O controller hub 305 is coupled to storage elements of the information handling system 300, including a storage element 306, which may include a flash ROM that includes a basic input/output system (BIOS) of the computer system. I/O controller hub 305 is also coupled to the hard drive 307 of the information handling system 300. I/O controller hub 305 may also be coupled to a Super I/O chip 308, which is itself coupled to several of the I/O ports of the computer system, including keyboard 309 and mouse 310, display 311.

In one or more embodiments, Super I/O chip 308 may be coupled to one or more communication links 312, which may include any type of communication channel, connector, data communication network, serial link, a wireless link (for example, infrared, radio frequency, or others), a parallel link, other types of links, and any combination thereof. For example, the communication link 312 may include a wireless or a wired network, a Local Area Network (LAN), a Wide Area Network (WAN), a private network, a public network (such as the Internet), a Wi-Fi network, a network that includes a satellite link, or another type of data communication network. The communication link 312 may communicate with the one or more communication links 242.

Figure 4:
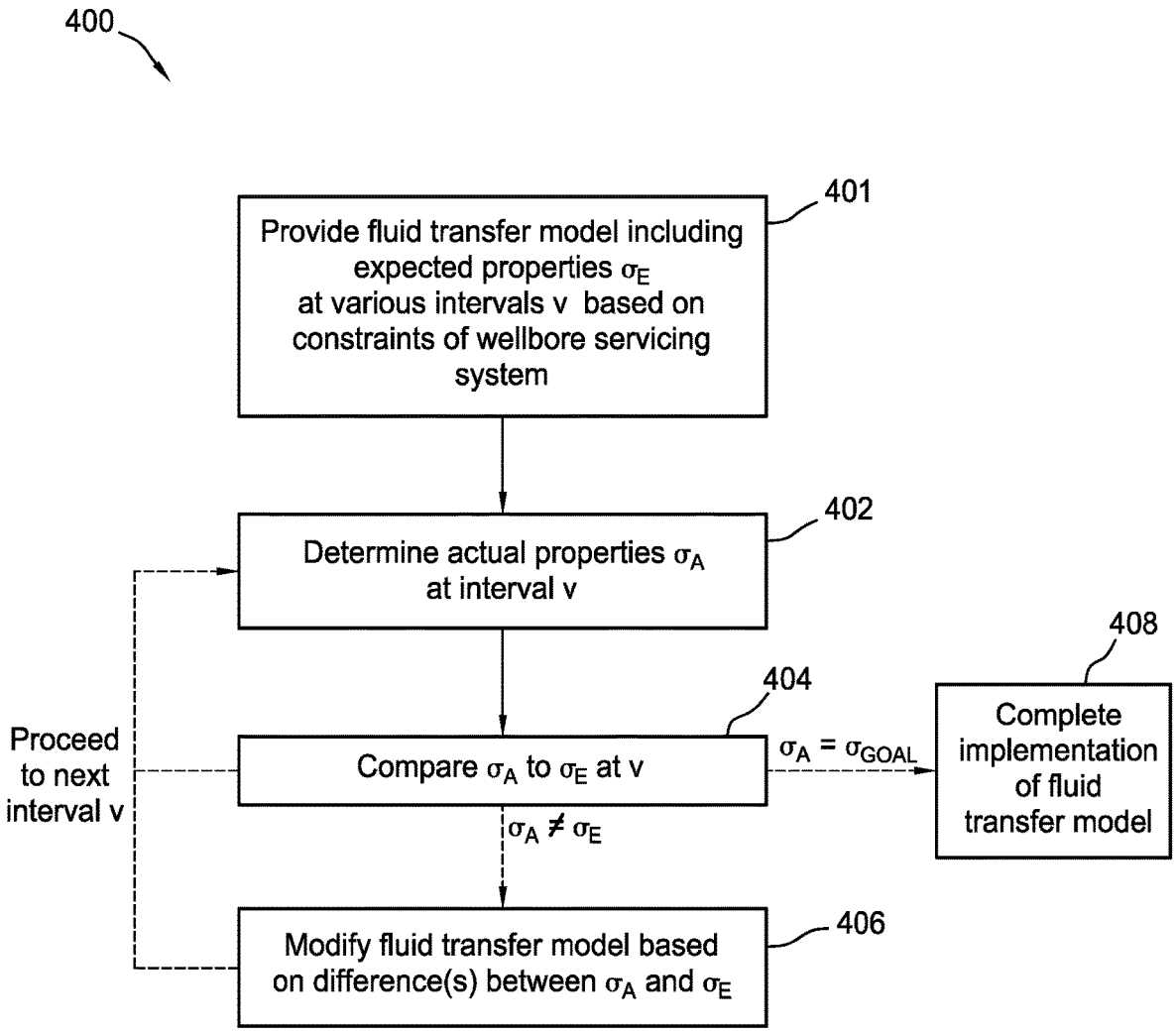
FIG. 4 is a flow chart illustrating a process for implementing a fluid transfer model, according to one or more aspects of the present invention.

FIG. 4 is an example flow chart 400 illustrating the implementation of a fluid transfer model. In one or more embodiments, an information handling system 300, of the wellbore monitoring system 210 as shown in FIG. 2, may implement any one or more steps of process 400. The process 400, one or more individual operations of the process 400, or groups of operations may be iterated or performed in parallel, in series, or in another manner. In one or more embodiments, the process 400 may include the same, additional, fewer, or different operations performed in the same or a different order. In one or more embodiments, process 400 tracks one or more actual properties (e.g., an actual density $\delta_A$ of return fluid at a return line) and compares the one or more actual properties to one or more expected properties (e.g., an expected density $\delta_E$ of the return fluid according to a fluid transfer model). For example, the expected density $\delta_E$ of return fluid according to a fluid transfer model is thereafter compared to the actual density $\delta_A$ of return fluid 266 collected at a return line 264 as shown in FIG. 2. The comparison may be used to indicate the accuracy of a fluid transfer model and adjust or modify the fluid transfer model. The calculations used in process 400 may involve any one or more of one or more governing equations, one or more empirical models, one or more associated variables, and any combination thereof. For illustrative purposes, a density of the return fluid is monitored to check the accuracy and adjust or modify a fluid transfer model. However, one of ordinary skill in the art may appreciate that one or more actual properties based on data obtained from a wellbore servicing system in addition to or in alternative to density may be monitored and compared to the expected properties of the fluid transfer model.

In step 401 of the illustrated embodiment, a fluid transfer model is designed or otherwise provided ahead of a fluid displacement operation based at least in part on one or more constraints of a wellbore servicing system 200 as illustrated in FIG. 2 (e.g., an actual density $\delta_A$ of return fluid at a return line). The constraints may be used to design one or more fluid transfer models including one or more expected properties $\delta_E$. The expected density data $\delta_E$ of the fluid transfer model(s) is determined analytically using known properties of one or more fluids in the wellbore. For instance, the one or more known properties may include a density, a percentage of solids, a viscosity, a pH, one or more other properties, and any combination thereof. For example, in one or more embodiments, the expected density data $\delta_E$ is determined using one or more models that use as inputs one or more known properties of wellbore servicing fluids 224, one or more known properties of existing fluids 250, one or more known properties of any other fluid in wellbore 218, and any combination thereof, as illustrated in FIG. 2. For example, the step 401 may use one or more one-dimensional models for fluid mixing generated by a hydraulics displacement simulation module to determine an expected density $\delta_E$ of a return sample, or the step 401 may use any other one or more flow models. The flow models may include one or more governing equations and one or more associated variables. As another example, a fluid transfer simulation module of the wellbore monitoring system 210 of FIG. 2 may determine the expected density $\delta_E$ or any other expected property of the fluid transfer model, at least in part, by coupling to a hydraulics displacement simulation module of the wellbore monitoring system 210, a spacer contamination simulation module of the wellbore monitoring system 210, and any combination thereof, and receiving simulation data from one or more of these modules to include in the fluid transfer model.

A plurality of expected density data $\delta_E$ for return fluids at one or more intervals during the displacement operation, may be modeled. The expected density data $\delta_E$ may be recorded at one or more intervals (e.g., at time t, after pump stroke p, or after volume v of wellbore servicing fluid has been circulated). For instance, an expected density $\delta_E$ may be determined after a certain volumetric intervals v of wellbore servicing fluid has been circulated. Calculations of expected density data $\delta_E$ have been described above. In one or more embodiments, step 401 may be implemented by the information handling system 300 of FIG. 3.

At step 402, actual density $\delta_A$ is determined for the return fluid (e.g., return fluid 266 at a return line 264 as shown in FIG. 2) after a certain interval (e.g., at time t, after pump stroke p, or after volume v of wellbore servicing fluid has been circulated) of the displacement operation. For instance, an actual density $\delta_A$ may be determined by collecting and analyzing a return fluid sample at the return line after one or more volumetric intervals. The return sample may be collected by one or more sampling systems (e.g., sampling system 246 in FIG. 2) in the wellbore. A plurality of actual density $\delta_A$ measurements may be obtained by collecting a plurality of return fluid samples at one or more volumetric intervals v during the displacement operation and/or after a certain volume of wellbore servicing fluid has been pumped downhole. An analysis is performed on each of the plurality of return samples to obtain one or more actual properties of the return fluid for each of the plurality of return samples. For instance, the one or more properties may include a density, a viscosity, a water content, an oil content, a solids content, a salt content, a capacitance, a thermal conductivity, an electrical conductivity, ES, pH, a percent transmittance, MEMS, a turbidity, a phase angle, other properties, and any combination thereof. The actual density $\delta_A$ may be recorded at one or more volumetric intervals v, plotted against the density of wellbore servicing fluids pumped in a displacement operation, plotted against the volume of the return fluids, plotted against time, and any combination thereof. In one or more embodiments, the information handling system 300 of FIG. 3 may implement step 402 by receiving and recording actual density $\delta_A$ data.

At step 404, a comparison is performed between the actual density data $\delta_A$ and the expected density data $\delta_E$ with relation to the volume of total circulated wellbore servicing fluid at the relevant interval v. In one or more embodiments, the volume of total circulated wellbore servicing fluid may be obtained by summing a plurality of individual volumes associated with a displacement train of one or more spacers 102A-n as illustrated in FIG. 1. In one or more embodiments, the volume is determined from the pump rate of pump 222 in wellbore servicing system 200 as illustrated in FIG. 2. The comparison between the actual density $\delta_A$ and expected density $\delta_E$ from step 404 with relation to the volume of total circulated wellbore servicing fluid may be used to characterize the accuracy of a fluid transfer model during the displacement operation. In one or more embodiments, one or more thermal effects for the wellbore servicing fluids, one or more thermal effects for the existing fluids in the wellbore, and one or more margins of error may be considered to avoid interferences with the comparison.

If the actual density $\delta_A$ falls within the expected density $\delta_E$ of the fluid transfer model, the fluid transfer model returns to step 402. If the actual density falls outside of the expected density of the fluid transfer model, the fluid transfer model is modified based on the comparison from step 404, as shown in step 406. The modification of the displacement operation may be performed through automated means, such as the wellbore fluid control subsystem 231 of FIG. 2, for example. For instance, if a density, viscosity, and/or TDS comparison indicates that a higher proportion of existing fluid to wellbore servicing fluid is present in the return fluid 266, the fluid transfer model may be modified to adjust the distribution of volumes of the return fluid 266 across one or more containers 232A-E, as illustrated in FIG. 2. As another example, if the comparison indicates a reduced operating volume for one or more containers, the fluid transfer model may be modified to adjust and/or redistribute the volume of wellbore servicing fluid transferred to the one or more containers in real time during the displacement operation.

The actual density $\delta_A$ and expected density $\delta_E$ may be compared and the fluid transfer model may be modified at different intervals during the displacement operation. In some embodiments, steps 402-406 may be performed continuously throughout part or all a displacement operation. In some embodiments, steps 402-406 may be performed at volumetric intervals v throughout part or all of a displacement operation. In some embodiments as shown in step 408, steps 402-406 may be performed until the actual density $\delta_A$ and/or one or more properties of the return fluid of the wellbore servicing system 200 are equivalent to one or more goal properties of the fluid transfer model (e.g., a goal density $\delta_{GOAL}$, equivalent to the density of spacer 102*n* as illustrated in FIG. 1), at which point implementation of the fluid transfer model may be terminated. In some embodiments, determination of goal density $\delta_{GOAL}$ may indicate termination of the displacement operation.

An embodiment of the present disclosure is a method including the steps of providing a fluid transfer model based at least in part on one or more constraints determined from data obtained from a wellbore servicing system, wherein the fluid transfer model includes one or more expected properties of the wellbore servicing system at one or more intervals during a fluid displacement operation; selecting a first set of one or more containers for transferring a wellbore servicing fluid to a wellbore based at least in part on at least one of the one or more expected properties of the wellbore servicing system; selecting a second set of one or more containers for transferring a return fluid from the wellbore based at least in part on at least one of the one or more expected properties of the wellbore servicing system; determining one or more actual properties of the wellbore servicing system from data obtained from the wellbore servicing system at the one or more intervals; comparing at least one of the one or more expected properties of the wellbore servicing system and at least one of the one or more actual properties of the wellbore servicing system; and if the one or more expected properties of the wellbore servicing system are different from the one or more actual properties of the wellbore servicing system, modifying at least one of the one or more expected properties of the wellbore servicing system. In some embodiments, the method further includes displaying in real time at least one of the constraints, expected properties, and the actual properties. In some embodiments, the one or more constraints of the fluid transfer model, one or more expected properties of the wellbore servicing system may include one or more actual properties of the wellbore servicing system include one or more surface properties selected from the group consisting of container layout, number of containers, surface container dimensions, one or more wellbore servicing fluid types, one or more wellbore servicing fluid volumes, one or more wellbore servicing fluid masses, one or more wellbore servicing fluid densities, number of flow paths, flow path dimensions, one or more surface temperatures, number of pumps, pump rate, pump pressures, one or more pump volumes, and any combination thereof. In some embodiments, the one or more constraints of the fluid transfer model, one or more expected properties of the wellbore servicing system may include one or more actual properties of the wellbore servicing system include one of the one or more constraints of the fluid transfer model, one or more expected properties of the wellbore servicing system, and one or more actual properties of the wellbore servicing system include one or more downhole properties selected from the group consisting of a wellbore dimensions, one or more wellbore temperatures, one or more return fluid types, one or more return fluid volumes, one or more return fluid masses, one or more return fluid densities, one or more contamination type, one or more contamination volumes, one or more contamination masses, one or more contamination densities, tool string assembly dimensions, wellbore pressures, lithology dimensions, and any combination thereof. In some embodiments, the one or more constraints of the fluid transfer model, one or more expected properties of the wellbore servicing system may include one or more actual properties of the wellbore servicing system include one of the one or more constraints of the fluid transfer model, one or more expected properties of the wellbore servicing system, and one or more actual properties of the wellbore servicing system include one or more defined properties selected from the group consisting of one or more environmental regulations, one or more maximum container operating volumes, one or more minimum container operating volumes, one or more fluid mixing limitations, one or more maximum pumping pressures, one or more target fluid specifications, and any combination thereof. In one or more embodiments, the wellbore servicing fluid is selected from the group consisting of a drilling fluid or mud, water, a spacer fluid, a completion fluid, a cement slurry, a non-cementitious sealant, a fracturing fluid, and any combination thereof.

Another embodiment of the present disclosure is a system including a non-transitory computer-readable medium storing one or more instructions that, when executed by a processor, cause the processor to: provide a fluid transfer model based at least in part on one or more constraints determined from data obtained from a wellbore servicing system, wherein the fluid transfer model includes one or more expected properties of the wellbore servicing system at one or more intervals during a fluid displacement operation; select a first set of one or more containers for transferring a wellbore servicing fluid to a wellbore based at least in part on at least one of the one or more expected properties of the wellbore servicing system; select a second set of one or more containers for transferring a return fluid from the wellbore based at least in part on at least one of the one or more expected properties of the wellbore servicing system; determine one or more actual properties of the wellbore servicing system from data obtained from the wellbore servicing system at the one or more intervals; compare at least one of the one or more expected properties of the wellbore servicing system and at least one of the one or more actual properties of the wellbore servicing system; and if the one or more expected properties of the wellbore servicing system are different from the one or more actual properties of the wellbore servicing system, modify at least one of the one or more expected properties of the wellbore servicing system. In some embodiments, the one or more constraints of the fluid transfer model, one or more expected properties of the wellbore servicing system may include one or more actual properties of the wellbore servicing system include one or more surface properties selected from the group consisting of container layout, number of containers, surface container dimensions, one or more wellbore servicing fluid types, one or more wellbore servicing fluid volumes, one or more wellbore servicing fluid masses, one or more wellbore servicing fluid densities, number of flow paths, flow path dimensions, one or more surface temperatures, number of pumps, pump rate, pump pressures, one or more pump volumes, and any combination thereof. In some embodiments, the one or more constraints of the fluid transfer model, one or more expected properties of the wellbore servicing system may include one or more actual properties of the wellbore servicing system include one of the one or more constraints of the fluid transfer model, one or more expected properties of the wellbore servicing system, and one or more actual properties of the wellbore servicing system include one or more downhole properties selected from the group consisting of a wellbore dimensions, one or more wellbore temperatures, one or more return fluid types, one or more return fluid volumes, one or more return fluid masses, one or more return fluid densities, one or more contamination type, one or more contamination volumes, one or more contamination masses, one or more contamination densities, tool string assembly dimensions, wellbore pressures, lithology dimensions, and any combination thereof. In some embodiments, the one or more constraints of the fluid transfer model, one or more expected properties of the wellbore servicing system may include one or more actual properties of the wellbore servicing system include one of the one or more constraints of the fluid transfer model, one or more expected properties of the wellbore servicing system, and one or more actual properties of the wellbore servicing system include one or more defined properties selected from the group consisting of one or more environmental regulations, one or more maximum container operating volumes, one or more minimum container operating volumes, one or more fluid mixing limitations, one or more maximum pumping pressures, one or more target fluid specifications, and any combination thereof. In one or more embodiments the one or more instructions when executed by the processor further cause the processor to display in real time at least one of the expected properties of the wellbore servicing system, the actual properties of the wellbore servicing system, and the comparison.

Another embodiment of the present disclosure is a system including a memory; a processor coupled to the memory, wherein the memory includes one or more instructions executable by the processor to: provide a fluid transfer model based at least in part on one or more constraints determined from data obtained from a wellbore servicing system, wherein the fluid transfer model includes one or more expected properties of the wellbore servicing system at one or more intervals during a fluid displacement operation; select a first set of one or more containers for transferring a wellbore servicing fluid to a wellbore based at least in part on at least one of the one or more expected properties of the wellbore servicing system; select a second set of one or more containers for transferring a return fluid from the wellbore based at least in part on at least one of the one or more expected properties of the wellbore servicing system; determine one or more actual properties of the wellbore servicing system from data obtained from the wellbore servicing system at the one or more intervals; compare at least one of the one or more expected properties of the wellbore servicing system and at least one of the one or more actual properties of the wellbore servicing system; and if the one or more expected properties of the wellbore servicing system are different from the one or more actual properties of the wellbore servicing system, modify at least one of the one or more expected properties of the wellbore servicing system. In one or more embodiments, In one or more embodiments, the one or more instructions executable by the processor further cause the processor to display in real time at least one of the constraints of the fluid transfer model, expected properties of the wellbore servicing system, and the actual properties of the wellbore servicing system. In one or more embodiments, the processor is further coupled to one or more sensors. In one or more embodiments, the one or more sensors are configured to measure one or more actual properties of the return fluid from the wellbore. In some embodiments, the one or more constraints of the fluid transfer model, one or more expected properties of the wellbore servicing system may include one or more actual properties of the wellbore servicing system include one or more surface properties selected from the group consisting of container layout, number of containers, surface container dimensions, one or more wellbore servicing fluid types, one or more wellbore servicing fluid volumes, one or more wellbore servicing fluid masses, one or more wellbore servicing fluid densities, number of flow paths, flow path dimensions, one or more surface temperatures, number of pumps, pump rate, pump pressures, one or more pump volumes, and any combination thereof. In some embodiments, the one or more constraints of the fluid transfer model, one or more expected properties of the wellbore servicing system may include one or more actual properties of the wellbore servicing system include one of the one or more constraints of the fluid transfer model, one or more expected properties of the wellbore servicing system, and one or more actual properties of the wellbore servicing system include one or more downhole properties selected from the group consisting of a wellbore dimensions, one or more wellbore temperatures, one or more return fluid types, one or more return fluid volumes, one or more return fluid masses, one or more return fluid densities, one or more contamination type, one or more contamination volumes, one or more contamination masses, one or more contamination densities, tool string assembly dimensions, wellbore pressures, lithology dimensions, and any combination thereof. In some embodiments, the one or more constraints of the fluid transfer model, one or more expected properties of the wellbore servicing system may include one or more actual properties of the wellbore servicing system include one of the one or more constraints of the fluid transfer model, one or more expected properties of the wellbore servicing system, and one or more actual properties of the wellbore servicing system include one or more defined properties selected from the group consisting of one or more environmental regulations, one or more maximum container operating volumes, one or more minimum container operating volumes, one or more fluid mixing limitations, one or more maximum pumping pressures, one or more target fluid specifications, and any combination thereof. In one or more embodiments, the information handling system further includes one or more modules selected from the group consisting of a hydraulics displacement simulation module, a spacer contamination simulation module, and any combination thereof.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

A number of examples have been described. Nevertheless, it will be understood that various modifications may be made. Accordingly, other embodiments are within the scope of the following claims.

What is claimed is:

1. A method comprising the steps of:

providing a fluid transfer model based at least in part on one or more constraints determined from data obtained from a wellbore servicing system, wherein the fluid transfer model comprises one or more expected properties of the wellbore servicing system at one or more intervals during a fluid displacement operation;

implementing the fluid displacement operation at the one or more intervals based on the fluid transfer model, wherein the implementing comprises:

selecting a first set of one or more containers for transferring a wellbore servicing fluid to a wellbore based at least in part on at least one of the one or more expected properties of the wellbore servicing system;

selecting a second set of one or more containers for transferring a return fluid from the wellbore based at least in part on at least one of the one or more expected properties of the wellbore servicing system;

determining one or more actual properties of the wellbore servicing system from data obtained from the wellbore servicing system at the one or more intervals;

comparing at least one of the one or more expected properties of the wellbore servicing system and at least one of the one or more actual properties of the wellbore servicing system;

detecting that the one or more expected properties of the wellbore servicing system are different from the one or more actual properties of the wellbore servicing system;

in response to the detecting, modifying the fluid transfer model by adjusting at least one of the one or more expected properties of the wellbore servicing system based on the differences between the one or more expected properties and the one or more actual properties of the wellbore servicing system; and implementing the fluid displacement operation based on the modified fluid transfer model comprising adjusting selection of at least one of the first set of one or more containers or the second set of one or more containers based on the adjusted one or more expected properties of the wellbore servicing system.

2. The method of claim 1, further comprising displaying in real time at least one of the constraints, expected properties, and the actual properties.

3. The method of claim 1 wherein at least one of the one or more constraints of the fluid transfer model, one or more expected properties of the wellbore servicing system, and one or more actual properties of the wellbore servicing system comprise one or more surface properties selected from the group consisting of container layout, number of containers, surface container dimensions, one or more wellbore servicing fluid types, one or more wellbore servicing fluid volumes, one or more wellbore servicing fluid masses, one or more wellbore servicing fluid densities, number of flow paths, flow path dimensions, one or more surface temperatures, number of pumps, pump rate, pump pressures, one or more pump volumes, and any combination thereof.

4. The method of claim 1 wherein at least one of the one or more constraints of the fluid transfer model, one or more expected properties of the wellbore servicing system, and one or more actual properties of the wellbore servicing system comprise one or more downhole properties selected from the group consisting of a wellbore dimensions, one or more wellbore temperatures, one or more return fluid types, one or more return fluid volumes, one or more return fluid masses, one or more return fluid densities, one or more contamination type, one or more contamination volumes, one or more contamination masses, one or more contamination densities, tool string assembly dimensions, wellbore pressures, lithology dimensions, and any combination thereof.

5. The method of claim 1 wherein at least one of the one or more constraints of the fluid transfer model, one or more expected properties of the wellbore servicing system, and one or more actual properties of the wellbore servicing system comprise one or more defined properties selected from the group consisting of one or more environmental regulations, one or more maximum container operating volumes, one or more minimum container operating volumes, one or more fluid mixing limitations, one or more maximum pumping pressures, one or more target fluid specifications, and any combination thereof.

6. The method of claim 1 wherein the wellbore servicing fluid is selected from the group consisting of a drilling fluid or mud, water, a spacer fluid, a completion fluid, a cement slurry, a non cementitious sealant, a fracturing fluid, and any combination thereof.

7. A non-transitory computer-readable medium storing one or more instructions that, when executed by a processor, cause the processor to:

provide a fluid transfer model based at least in part on one or more constraints determined from data obtained from a wellbore servicing system, wherein the fluid transfer model comprises one or more expected properties of the wellbore servicing system at one or more intervals during a fluid displacement operation;

implement the fluid displacement operation at the one or more intervals based on the fluid transfer model, wherein the implementing comprises:

select a first set of one or more containers for transferring a wellbore servicing fluid to a wellbore based at least in part on at least one of the one or more expected properties of the wellbore servicing system;

select a second set of one or more containers for transferring a return fluid from the wellbore based at least in part on at least one of the one or more expected properties of the wellbore servicing system;

determine one or more actual properties of the wellbore servicing system from data obtained from the wellbore servicing system at the one or more intervals;

compare at least one of the one or more expected properties of the wellbore servicing system and at least one of the one or more actual properties of the wellbore servicing system;

detect that the one or more expected properties of the wellbore servicing system are different from the one or more actual properties of the wellbore servicing system;

in response to the detecting, modify the fluid transfer model by adjusting at least one of the one or more expected properties of the wellbore servicing system based on the differences between the one or more expected properties and the one or more actual properties of the wellbore servicing system; and implement the fluid displacement operation based on the modified fluid transfer model comprising adjusting selection of at least one of the first set of one or more containers or the second set of one or more containers based on the adjusted one or more expected properties of the wellbore servicing system.

8. The system of claim 7 wherein at least one of the one or more constraints of the fluid transfer model, one or more expected properties of the wellbore servicing system, and one or more actual properties of the wellbore servicing system comprise one or more surface properties selected from the group consisting of container layout, number of containers, surface container dimensions, one or more wellbore servicing fluid types, one or more wellbore servicing fluid volumes, one or more wellbore servicing fluid masses, one or more wellbore servicing fluid densities, number of flow paths, flow path dimensions, one or more surface temperatures, number of pumps, pump rate, pump pressures, one or more pump volumes, and any combination thereof.

9. The system of claim 7 wherein at least one of the one or more constraints of the fluid transfer model, one or more expected properties of the wellbore servicing system, and one or more actual properties of the wellbore servicing system comprise one or more downhole properties selected from the group consisting of a wellbore dimensions, one or more wellbore temperatures, one or more return fluid types, one or more return fluid volumes, one or more return fluid masses, one or more return fluid densities, one or more contamination type, one or more contamination volumes, one or more contamination masses, one or more contamination densities, tool string assembly dimensions, wellbore pressures, lithology dimensions, and any combination thereof.

10. The system of claim 7 wherein at least one of the one or more constraints of the fluid transfer model, one or more expected properties of the wellbore servicing system, and one or more actual properties of the wellbore servicing system comprise one or more defined properties selected from the group consisting of one or more environmental regulations, one or more maximum container operating volumes, one or more minimum container operating volumes, one or more fluid mixing limitations, one or more maximum pumping pressures, one or more target fluid specifications, and any combination thereof.

11. The system of claim 7, wherein the one or more instructions when executed by the processor further cause the processor to display in real time at least one of the expected properties of the wellbore servicing system, the actual properties of the wellbore servicing system, and the comparison.

12. An information handling system comprising:

a memory;

a processor coupled to the memory, wherein the memory comprises one or more instructions executable by the processor to:

provide a fluid transfer model based at least in part on one or more constraints determined from data obtained from a wellbore servicing system, wherein the fluid transfer model comprises one or more expected properties of the wellbore servicing system at one or more intervals during a fluid displacement operation;

implement the fluid displacement operation at the one or more intervals based on the fluid transfer model, wherein the implementing comprises:

select a first set of one or more containers for transferring a wellbore servicing fluid to a wellbore based at least in part on at least one of the one or more expected properties of the wellbore servicing system;

select a second set of one or more containers for transferring a return fluid from the wellbore based at least in part on at least one of the one or more expected properties of the wellbore servicing system;

determine one or more actual properties of the wellbore servicing system from data obtained from the wellbore servicing system at the one or more intervals;

compare at least one of the one or more expected properties of the wellbore servicing system and at least one of the one or more actual properties of the wellbore servicing system;

detect that the one or more expected properties of the wellbore servicing system are different from the one or more actual properties of the wellbore servicing system;

in response to the detecting, modify the fluid transfer model by adjusting at least one of the one or more expected properties of the wellbore servicing system based on the differences between the one or more expected properties and the one or more actual properties of the wellbore servicing system; and implement the fluid displacement operation based on the modified fluid transfer model comprising adjusting selection of at least one of the first set of one or more containers or the second set of one or more containers based on the adjusted one or more expected properties of the wellbore servicing system.

13. The information handling system of claim 12, wherein the one or more instructions further executable by the processor further cause the processor to display in real time at least one of the constraints of the fluid transfer model, expected properties of the wellbore servicing system, and the actual properties of the wellbore servicing system.

14. The information handling system of claim 12, wherein the processor is further coupled to one or more sensors.

15. The information handling system of claim 14 wherein the one or more sensors are configured to measure one or more actual properties of the return fluid from the wellbore.

16. The information handling system of claim 14 wherein the one or more sensors are configured to measure one or more actual properties of the one or more containers.

17. The information handling system of claim 12 wherein at least one of the one or more constraints of the fluid transfer model, one or more expected properties of the wellbore servicing system, and one or more actual properties of the wellbore servicing system comprise one or more surface properties selected from the group consisting of container layout, number of containers, surface container dimensions, one or more wellbore servicing fluid types, one or more wellbore servicing fluid volumes, one or more wellbore servicing fluid masses, one or more wellbore servicing fluid densities, number of flow paths, flow path dimensions, one or more surface temperatures, number of pumps, pump rate, pump pressures, one or more pump volumes, and any combination thereof.

18. The information handling system of claim 12 wherein at least one of the one or more constraints of the fluid transfer model, one or more expected properties of the wellbore servicing system, and one or more actual properties of the wellbore servicing system comprise one or more downhole properties selected from the group consisting of a wellbore dimensions, one or more wellbore temperatures, one or more return fluid types, one or more return fluid volumes, one or more return fluid masses, one or more return fluid densities, one or more contamination type, one or more contamination volumes, one or more contamination masses, one or more contamination densities, tool string assembly dimensions, wellbore pressures, lithology dimensions, and any combination thereof.

19. The information handling system of claim 12 wherein at least one of the one or more constraints of the fluid transfer model, one or more expected properties of the wellbore servicing system, and one or more actual properties of the wellbore servicing system comprise one or more defined properties selected from the group consisting of one or more environmental regulations, one or more maximum container operating volumes, one or more minimum container operating volumes, one or more fluid mixing limitations, one or more maximum pumping pressures, one or more target fluid specifications, and any combination thereof.

20. The information handling system of claim 12 further comprising one or more modules selected from the group consisting of a hydraulics displacement simulation module, a spacer contamination simulation module, and any combination thereof.

* * * * *